US005906113A

United States Patent [19]

Lynch et al.

[11] Patent Number: 5,906,113

[45] Date of Patent: May 25, 1999

[54] SERIAL COLUMN CRYOGENIC RECTIFICATION SYSTEM FOR PRODUCING HIGH PURITY NITROGEN

[75] Inventors: Nancy Jean Lynch, Tonawanda; Mark Edward Vincett, Lancaster; Dante Patrick Bonaquist, Grand Island; Kevin John Potempa, Amherst, all of N.Y.

[73] Assignee: Praxair Technology, Inc., Danbury, Conn.

[21] Appl. No.: 09/056,708

[22] Filed: Apr. 8, 1998

[51] Int. Cl.[6] ..... F25J 3/00

[52] U.S. Cl. ..... 62/646; 62/653

[58] Field of Search ..... 62/646, 653

[56] References Cited

U.S. PATENT DOCUMENTS

| | | | |
|---|---|---|---|
| 4,698,079 | 10/1987 | Yoshino | 62/11 |
| 4,902,321 | 2/1990 | Cheung | 62/24 |
| 5,098,457 | 3/1992 | Cheung et al. | 62/24 |
| 5,106,398 | 4/1992 | Dunn et al. | 62/20 |
| 5,123,947 | 6/1992 | Agrawal | 62/27 |
| 5,170,630 | 12/1992 | Stern | 62/24 |
| 5,205,127 | 4/1993 | Agrawal | 62/24 |
| 5,345,773 | 9/1994 | Nagamura et al. | 62/38 |
| 5,349,822 | 9/1994 | Nagamura et al. | 62/39 |
| 5,398,514 | 3/1995 | Roberts et al. | 62/646 |
| 5,402,647 | 4/1995 | Bonaquist et al. | 62/24 |
| 5,467,601 | 11/1995 | Paolino et al. | 62/646 |
| 5,469,710 | 11/1995 | Howard et al. | 62/646 |
| 5,511,380 | 4/1996 | Ha | 62/646 |

*Primary Examiner*—Ronald Capossela
*Attorney, Agent, or Firm*—Stanley Ktorides

[57] ABSTRACT

A serial column system for producing relatively large quantities of both high purity nitrogen gas and high purity nitrogen liquid using a first column producing the high purity gas and a second column producing the high purity liquid, with second column top fluid refluxing the first column.

10 Claims, 1 Drawing Sheet

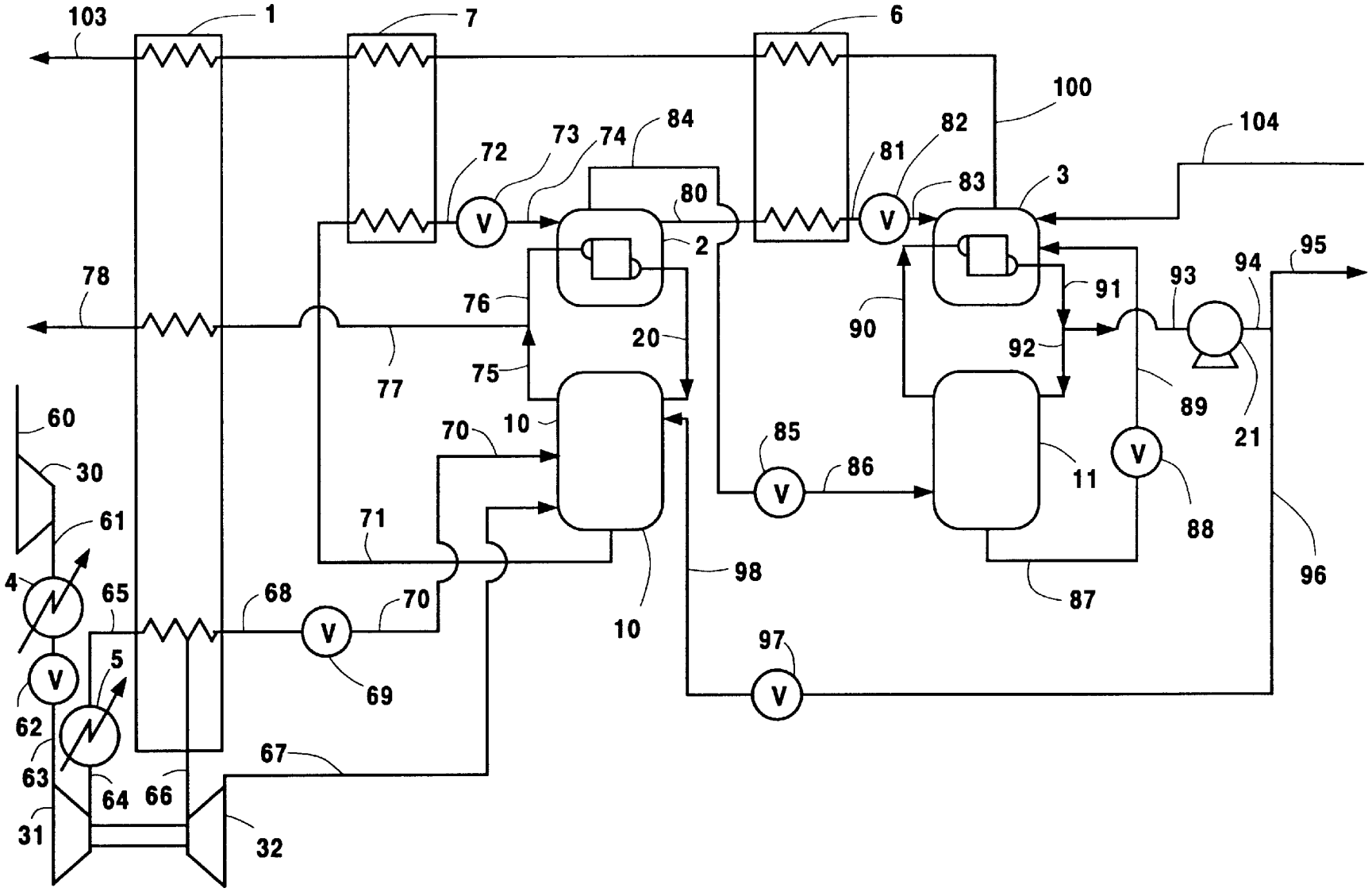
95
96
104
94
21
93
89
88
91
11
87
100
3
92
82
83
81
6
90
86
85
97
98
80
2
84
20
10
74
73
72
76
75
10
70
7
77
71
70
69
1
68
67
32
66
103
78
65
5
64
61
30
60
4
62
63
31

SERIAL COLUMN CRYOGENIC RECTIFICATION SYSTEM FOR PRODUCING HIGH PURITY NITROGEN

TECHNICAL FIELD

This invention relates generally to cryogenic rectification and, more particularly, to the production of high purity nitrogen.

BACKGROUND ART

High purity nitrogen gas is finding increasing use as a blanketing or inerting gas in the manufacturing of high value components, such as semiconductors, where freedom from contamination by oxygen is critical to the manufacturing process. Typically the high purity nitrogen is produced by the cryogenic rectification of air and piped directly to the semiconductor manufacturing plant. While such cryogenic air separation plants are highly reliable, these plants, like all production facilities, are subject to disruptions which could cause a reduction or stoppage of the high purity nitrogen flow from the cryogenic air separation plant to the semiconductor manufacturing plant. To avoid the catastrophic consequences of such a flow reduction or stoppage, high purity nitrogen plants have a liquid storage tank filled with liquid high purity nitrogen which can be quickly vaporized and passed on to the semiconductor manufacturing plant if the need arises.

While the high purity nitrogen plant may be able to produce some high purity nitrogen as liquid, at best it can produce only small quantities of such liquid. Accordingly, it is conventional practice to bring liquid high purity nitrogen to the storage tank by tanker truck or other transport means from a distant high purity liquid nitrogen production plant. While this conventional practice serves the intended purpose of maintaining the storage tank filled with liquid high purity nitrogen in case the need for its use arises, it is costly and cumbersome. It is desirable to have a facility which can produce high purity nitrogen gas and can also produce relatively large quantities of high purity nitrogen liquid so that transport of such liquid to the facility may be eliminated.

Accordingly, it is an object of this invention to provide a cryogenic rectification system which can produce relatively large quantities of both high purity nitrogen gas and high purity nitrogen liquid.

SUMMARY OF THE INVENTION

The above and other objects, which will become apparent to those skilled in the art upon reading this disclosure, are attained by the present invention, one aspect of which is:

A method for producing high purity nitrogen gas and high purity nitrogen liquid comprising:

(A) passing feed air into a first column and separating the feed air by cryogenic rectification within the first column into first high purity nitrogen vapor and first oxygen-enriched fluid;

(B) recovering a portion of the first high purity nitrogen vapor as high purity nitrogen gas;

(C) passing first oxygen-enriched fluid into the lower portion of a second column and separating the first oxygen-enriched fluid by cryogenic rectification within the second column into second high purity nitrogen vapor and into second oxygen-enriched fluid;

(D) condensing second high purity nitrogen vapor to produce high purity nitrogen liquid; and (E) passing at least a portion of the high purity nitrogen liquid into the upper portion of the first column.

Another aspect of the invention is:

Apparatus for producing high purity nitrogen by cryogenic rectification comprising:

(A) a first column having a top condenser and means for passing feed air into the first column;

(B) means for recovering high purity nitrogen from the upper portion of the first column;

(C) a second column having a top condenser and means for passing fluid from the lower portion of the first column into the second column;

(D) means for passing fluid from the upper portion of the second column into the second column top condenser; and (E) means for passing fluid from the second column top condenser into the upper portion of the first column.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "top condenser" means a heat exchange device that generates column downflow liquid from column vapor.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "high purity nitrogen" means a fluid having a nitrogen concentration of at least 99 mole percent, preferably at least 99.9 mole percent, most preferably at least 99.999 mole percent.

BRIEF DESCRIPTION OF THE DRAWING

The sole FIGURE is a simplified schematic representation of one preferred embodiment of the cryogenic rectification system of this invention.

DETAILED DESCRIPTION

The invention will be described in detail with reference to the Drawing. Referring now to the FIGURE, feed air 60 is compressed by passage through base load compressor 30 to a pressure generally within the range of from 250 to 600 pounds per square inch absolute (psia). Resulting compressed feed air 61 is cooled of heat of compression in cooler 4 and passed through valve 62 as stream 63 into compressor 31 which is mechanically coupled to turboexpander 32. Feed air 63 is further compressed in compressor 31 to a pressure generally within the range of from 300 to 900 psia. Resulting further compressed feed air 64 is cooled of heat of compression by passage through cooler 5 and resulting feed air 65 is passed to primary heat exchanger 1 wherein it is cooled by indirect heat exchange with return streams.

A first portion 68 of feed air 65 completely traverses primary heat exchanger 1 wherein it is condensed, and thereafter is passed through valve 69 and, as stream 70, into the lower portion of first column 10. If desired, a liquid or two phase expander may be employed in place of valve 69. A second portion 66 of feed air 65 is withdrawn from primary heat exchanger 1 after partial traverse, and turboexpanded by passage through turboexpander 32 which drives compressor 31. Resulting turboexpanded feed air 67 is passed into first column 10.

First column 10 is operating at a pressure generally within the range of from 120 to 180 psia. Within first column 10 the feed air is separated by cryogenic rectification into first high purity nitrogen vapor and first oxygen-enriched fluid. First oxygen-enriched fluid is withdrawn from the lower portion of first column 10 in liquid stream 71 and subcooled by passage through subcooler or waste superheater 7. Resulting subcooled first oxygen-enriched liquid 72 is passed through valve 73 and as stream 74 into first column top condenser 2.

First high purity nitrogen vapor is withdrawn from the upper portion of first column 10 as stream 75 and a first portion 77 of stream 75 is warmed by passage through primary heat exchanger 1 and recovered as product high purity nitrogen gas 78. A second portion 76 of first high purity nitrogen vapor 75 is passed into first column top condenser 2 wherein it is condensed by indirect heat exchange with the first oxygen-enriched fluid. The resulting condensed high purity nitrogen liquid is passed in stream 20 from first column top condenser 2 into the upper portion of first column 10 as reflux.

First oxygen-enriched liquid 74 is partially vaporized by the aforesaid indirect heat exchange with the first high purity vapor in first column top condenser 2. The resulting first oxygen-enriched vapor is passed in stream 84 from first column top condenser 2 through valve 85 and as stream 86 into the lower portion of second column 11. The remaining oxygen-enriched liquid is withdrawn from first column top condenser 2 in stream 80 and subcooled by passage through subcooler or waste superheater 6. Resulting subcooled stream 81 is passed through valve 82 and as stream 83 into second column top condenser 3.

Second column 11 is operating at a pressure generally within the range of from 40 to 70 psia. Within second column 11 the first oxygen-enriched fluid is separated by cryogenic rectification into second high purity nitrogen vapor and into second oxygen-enriched fluid. The second oxygen-enriched fluid is withdrawn from the lower portion of second column 11 as liquid stream 87, passed through valve 88 and as stream 89 into second column top condenser 3. If desired, additional or exogenous liquid 104 may also be passed into the boiling side of second column top condenser 3 along with first oxygen-enriched liquid 83 and second oxygen-enriched liquid 89.

Second high purity nitrogen vapor is withdrawn from the upper portion of second column 11 and passed as stream 90 into the condensing side of second column top condenser 3 wherein it is condensed by indirect heat exchange with the fluids which were passed into the boiling side of second column top condenser 3. The resulting boil-off vapor is withdrawn from second column top condenser 3 in stream 100 warmed by passage through superheaters 6 and 7 and primary heat exchanger 1 and removed from the system in stream 103.

Condensed second high purity nitrogen liquid is withdrawn from second column top condenser 3 in stream 91 and a first portion thereof is passed as stream 92 into the upper portion of second column 11 as reflux. A second portion 93 of high purity nitrogen liquid 91 is pumped through liquid pump 21 to form pumped high purity nitrogen liquid stream 94. If desired, a portion 95 of stream 94 may be recovered as high purity nitrogen liquid product. The remainder 96 of stream 94 is passed through valve 97 and as stream 98 into the upper portion of first column 10 as additional reflux enabling the serial dual column system to produce relatively large quantities of high purity nitrogen gas and liquid from the first column and from the second column top condenser respectively.

Although the invention has been described in detail with reference to a certain preferred embodiment, those skilled in the art will recognize that there are other embodiments of the invention within the spirit and the scope of the claims.

We claim:

1. A method for producing high purity nitrogen gas and high purity nitrogen liquid comprising:

(A) passing feed air into a first column and separating the feed air by cryogenic rectification within the first column into first high purity nitrogen vapor and first oxygen-enriched fluid;

(B) recovering a portion of the first high purity nitrogen vapor as high purity nitrogen gas;

(C) passing first oxygen-enriched fluid into the lower portion of a second column and separating the first oxygen-enriched fluid by cryogenic rectification within the second column into second high purity nitrogen vapor and into second oxygen-enriched fluid;

(D) condensing second high purity nitrogen vapor to produce high purity nitrogen liquid; and (E) passing at least a portion of the high purity nitrogen liquid into the upper portion of the first column.

2. The method of claim 1 wherein a portion of the feed air is turboexpanded prior to being passed into the first column.

3. The method of claim 1 further comprising recovering a portion of the high purity nitrogen liquid.

4. The method of claim 1 wherein the second high purity nitrogen vapor is condensed by indirect heat exchange with second oxygen-enriched fluid.

5. The method of claim 1 wherein the second high purity nitrogen vapor is condensed by indirect heat exchange with first oxygen-enriched fluid.

6. Apparatus for producing high purity nitrogen by cryogenic rectification comprising:

(A) a first column having a top condenser and means for passing feed air into the first column;

(E) means for recovering high purity nitrogen from the upper portion of the first column;

(C) a second column having a top condenser and means for passing fluid from the lower portion of the first column into the second column;

(D) means for passing fluid from the upper portion of the second column into the second column top condenser; and (E) means for passing fluid from the second column top condenser into the upper portion of the first column.

7. The apparatus of claim 6 wherein the means for passing fluid from the lower portion of the first column into the second column includes the first column top condenser.

8. The apparatus of claim 6 further comprising means for passing fluid from the first column top condenser into the second column top condenser.

9. The apparatus of claim 6 further comprising means for passing fluid from the lower portion of the second column into the second column top condenser.

10. The apparatus of claim 6 further comprising means for recovering high purity nitrogen liquid from the second column top condenser.

* * * * *